US007646270B2

(12) United States Patent
Spitsberg et al.

(10) Patent No.: US 7,646,270 B2
(45) Date of Patent: Jan. 12, 2010

(54) ELECTRICAL SWITCHING APPARATUS, AND YOKE ASSEMBLY AND SPRING ASSEMBLY THEREFOR

(75) Inventors: Yuri Spitsberg, Export, PA (US); Robert M. Slepian, Murrysville, PA (US); Perry R. Gibson, East Palestine, OH (US); David A. Parks, Baden, PA (US); Douglas C. Marks, Murrysville, PA (US); Paul R. Rakus, Beaver Falls, PA (US); Nathan J. Weister, Darlington, PA (US); Henry A. Wehrli, III, Monroeville, PA (US)

(73) Assignee: Eaton Corporation, Cleveland, OH (US)

( * ) Notice: Subject to any disclaimer, the term of this patent is extended or adjusted under 35 U.S.C. 154(b) by 243 days.

(21) Appl. No.: 11/744,431

(22) Filed: May 4, 2007

(65) Prior Publication Data

US 2008/0271981 A1 Nov. 6, 2008

(51) Int. Cl.
*H01H 9/00* (2006.01)

(52) U.S. Cl. ..... 335/172; 335/6; 335/8; 335/12; 335/15; 335/16; 335/46; 335/73; 335/106; 335/167; 335/190; 335/192; 335/193; 335/194; 335/195; 335/191; 335/196; 200/42; 200/43; 200/44; 200/45; 200/46; 200/47

(58) Field of Classification Search ..... 335/6, 335/8, 12, 15, 16, 46, 73, 106, 167, 172, 335/190–196; 200/42–47
See application file for complete search history.

(56) References Cited

U.S. PATENT DOCUMENTS

| | | | | | |
|---|---|---|---|---|---|
| 3,360,751 | A * | 12/1967 | Gauthier et al. | ..... | 335/175 |
| 4,129,762 | A * | 12/1978 | Bruchet | ..... | 200/401 |
| 4,146,855 | A * | 3/1979 | Schultz et al. | ..... | 335/8 |
| 6,015,959 | A | 1/2000 | Slepian et al. | | |
| 6,891,453 | B2 * | 5/2005 | Castonguay et al. | ..... | 335/8 |
| 7,034,642 | B1 * | 4/2006 | Rakus et al. | ..... | 335/16 |
| 2008/0245648 | A1 * | 10/2008 | Weister et al. | ..... | 200/556 |
| 2008/0245649 | A1 * | 10/2008 | Spitsberg et al. | ..... | 200/556 |
| 2008/0246565 | A1 * | 10/2008 | Spitsberg et al. | ..... | 335/166 |

* cited by examiner

*Primary Examiner*—Elvin G Enad
*Assistant Examiner*—Mohamad A Musleh
(74) *Attorney, Agent, or Firm*—Martin J. Moran

(57) ABSTRACT

A spring assembly is provided for a yoke assembly of an electrical switching apparatus including a housing, separable contacts enclosed by the housing, and an operating mechanism structured to open and close the separable contacts. The operating mechanism includes a pole shaft. The yoke assembly is coupled to the pole shaft and is movable among first and second positions corresponding to the separable contacts being closed and open, respectively. The spring assembly includes a number of first springs having a first spring rate and being coupled to the yoke assembly, and a number of second springs having a second spring rate and being coupled to the yoke assembly. The second spring rate is different than the first spring rate. The number of first springs and the number of second springs bias the yoke assembly toward the second position.

6 Claims, 4 Drawing Sheets

ELECTRICAL SWITCHING APPARATUS, AND YOKE ASSEMBLY AND SPRING ASSEMBLY THEREFOR

CROSS-REFERENCE TO RELATED APPLICATIONS

This application is related to co-pending, commonly assigned:

U.S. patent application Ser. No. 11/696,810, filed Apr. 5, 2007, and entitled "ELECTRICAL SWITCHING APPARATUS AND TRIP ACTUATOR ASSEMBLY THEREFOR";

U.S. patent application Ser. No. 11/696,815, filed Apr. 5, 2007, and entitled "ELECTRICAL SWITCHING APPARATUS, AND TRIP ACTUATOR ASSEMBLY AND RESET ASSEMBLY THEREFOR"; and U.S. patent application Ser. No. 11/696,812, filed Apr. 5, 2007, and entitled "ELECTRICAL SWITCHING APPARATUS AND TRIP ACTUATOR RESET ASSEMBLY THEREFOR", which are hereby incorporated herein by reference.

BACKGROUND OF THE INVENTION

1. Field of the Invention

The invention relates generally to electrical switching apparatus and, more particularly, to yoke assemblies for electrical switching apparatus, such as circuit breakers. The invention also relates to spring assemblies for circuit breaker yoke assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Among other components, the operating mechanisms of some low-voltage circuit breakers, for example, typically include a pole shaft and a spring assembly. The pole shaft is pivotable among an open position, corresponding to the electrical contact assemblies being open (e.g., contacts separated), and a closed position, corresponding to the electrical contact assemblies being closed (e.g., contacts electrically connected). The spring assembly includes at least one spring that is typically coupled to the circuit breaker housing and, directly or indirectly, to the pole shaft. The spring or springs is/are structured to bias the pole shaft, for example, to facilitate opening of the electrical contact assemblies.

It is desirable to optimize the operation of the spring assembly, in order to improve circuit breaker performance, for example, by enabling the electrical contact assemblies to open rapidly. It is also desirable to minimize the space required for the spring assembly. These two objectives are somewhat contradictory, and are difficult to achieve because of the limited amount of space that is available within the circuit breaker. This is particularly true in view of the increasing trend to minimize the overall size of the circuit breaker. It is, therefore, difficult to effectively arrange the spring assembly and/or related structures within the circuit breaker housing in a manner that affords the desired leverage and spring energy. In this regard, known circuit breaker designs leave much to be desired.

There is, therefore, room for improvement in electrical switching apparatus, such as circuit breakers, and in spring assemblies therefor.

SUMMARY OF THE INVENTION

These needs and others are met by embodiments of the invention, which are directed to a yoke assembly and spring assembly therefor for electrical switching apparatus, such as circuit breakers.

As one aspect of the invention, a spring assembly is provided for a yoke assembly of an electrical switching apparatus including a housing, separable contacts enclosed by the housing, and an operating mechanism structured to open and close the separable contacts. The operating mechanism includes a pole shaft. The yoke assembly is coupled to the pole shaft and is movable among a first position corresponding to the separable contacts being closed, and a second position corresponding to the separable contacts being open. The spring assembly comprises: a number of first springs having a first spring rate and being structured to be coupled to the yoke assembly; and a number of second springs having a second spring rate and being structured to be coupled to the yoke assembly. The second spring rate is different than the first spring rate. The number of first springs and the number of second springs are structured to bias the yoke assembly toward the second position.

The yoke assembly may comprise a first end coupled to the pole shaft, a second end, a first side, and a second side. The first side of the yoke assembly may extend from the pole shaft toward the second end of the yoke assembly, and the second side of the yoke assembly may be disposed opposite and distal from the first side. The number of first springs and the number of second springs may be structured to be disposed between the first side and the second side. The yoke assembly may further comprise a first cross member extending between the first side and the second side proximate the first end of the yoke assembly, a second cross member extending between the first side and the second side proximate the second end of the yoke assembly, and a plurality of elongated members having first ends and second ends. The first ends of the elongated members may be fixedly coupled to the second cross member, and the second ends of the elongated members may extend through the first cross member and may be movable with respect to the first cross member. The number of first springs and the number of second springs may be structured to be disposed between the first cross member and the second cross member, and may include a plurality of coils structured to receive a corresponding one of the elongated members therethrough.

The number of first springs may be two first springs, and the number of second springs may be a single second spring, wherein the single second spring is disposed on a corresponding one of the elongated members between the two first springs. The single second spring may include a first end and a second end wherein, when the yoke assembly is disposed in the first position, the first end of the single second spring is structured to be disposed at or about the first cross member and the second end of the single second spring is structured to be disposed at or about the second cross member and wherein, when the yoke assembly is disposed in the second position, the first end of the single second spring is structured to be spaced apart from the first cross member. The first spring rate may be lower than the second spring rate.

As another aspect of the invention, a yoke assembly is provided for an electrical switching apparatus including a housing, separable contacts enclosed by the housing, and an operating mechanism structured to open and close the separable contacts. The operating mechanism includes a pole shaft. The yoke assembly comprises: a first end structured to be coupled to the pole shaft; a second end; a first side extending from the first end toward the second end; a second side disposed opposite and distal from the first side; at least one cross member extending between the first side and the second side; and a spring assembly comprising: a number of first springs having a first spring rate and being coupled to the yoke assembly, and a number of second springs having a second spring rate and being coupled to the yoke assembly. The second spring rate is different than the first spring rate. The yoke assembly is structured to be movable among a first position corresponding to the separable contacts being closed, and a second position corresponding to the separable contacts being open. The number of first springs and the number of second springs bias the yoke assembly toward the second position.

The housing of the electrical switching apparatus may include a mounting surface, a first side plate extending outwardly from the mounting surface, a second side plate extending outwardly from the mounting surface opposite the first side plate, and a guide member extending between the first side plate and the second side plate. The yoke assembly may be disposed between the first side plate and the second side plate. When the yoke assembly moves from the first position toward the second position, at least one of the first side and the second side may be structured to engage the guide member and to slide with respect to the guide member. The housing may further include a pin member extending between the first side plate and the second side plate. Each of the number of first springs and the number of second springs may comprise a first portion and a second portion. The first portion may include a plurality of coils having a first end and a second end coupled to the yoke assembly at or about the second end thereof. The second portion may be substantially flat and may include a first end structured to be coupled to the pin member, and a second end coupled to the first portion at or about the first end of the first portion.

As another aspect of the invention, an electrical switching apparatus comprises: a housing; separable contacts enclosed by the housing; an operating mechanism structured to open and close the separable contacts, the operating mechanism including a pole shaft; and a yoke assembly coupled to the housing, the yoke assembly comprising: a first end coupled to the pole shaft, a second end, a first side extending from the first end toward the second end, a second side disposed opposite and distal from the first side, at least one cross member extending between the first side and the second side, and a spring assembly comprising: a number of first springs having a first spring rate and being coupled to the yoke assembly, and a number of second springs having a second spring rate and being coupled to the yoke assembly. The second spring rate is different than the first spring rate. The yoke assembly is movable among a first position corresponding to the separable contacts being closed, and a second position corresponding to the separable contacts being open. The number of first springs and the number of second springs bias the yoke assembly toward the second position.

The electrical switching apparatus may be a circuit breaker. The housing of the circuit breaker may include at least one of an indicator and an interlock. At least one of the first side of the yoke assembly and the second side of the yoke assembly may be coupled directly to a corresponding one of such indicator and such interlock. Movement of the yoke assembly may actuate the corresponding one of such indicator and such interlock.

As another aspect of the invention, an electrical switching apparatus comprises: a housing including a mounting surface, a first side plate extending outwardly from the mounting surface, and a second side plate extending outwardly from the mounting surface opposite the first side plate; a guide member extending between the first side plate and the second side plate; separable contacts enclosed by the housing; an operating mechanism structured to open and close the separable contacts, the operating mechanism including a pole shaft; and a yoke assembly disposed between the first side plate and the second side plate housing, the yoke assembly comprising: a first end coupled to the pole shaft, a second end, a first side extending from the first end toward the second end, a second side disposed opposite and distal from the first side, and at least one spring coupled to the yoke assembly. The yoke assembly is movable among a first position and a second position. When the yoke assembly moves between the first position and the second position, the at least one spring biases the yoke assembly toward engagement with the guide member, in order that the guide member guides the movement of the yoke assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
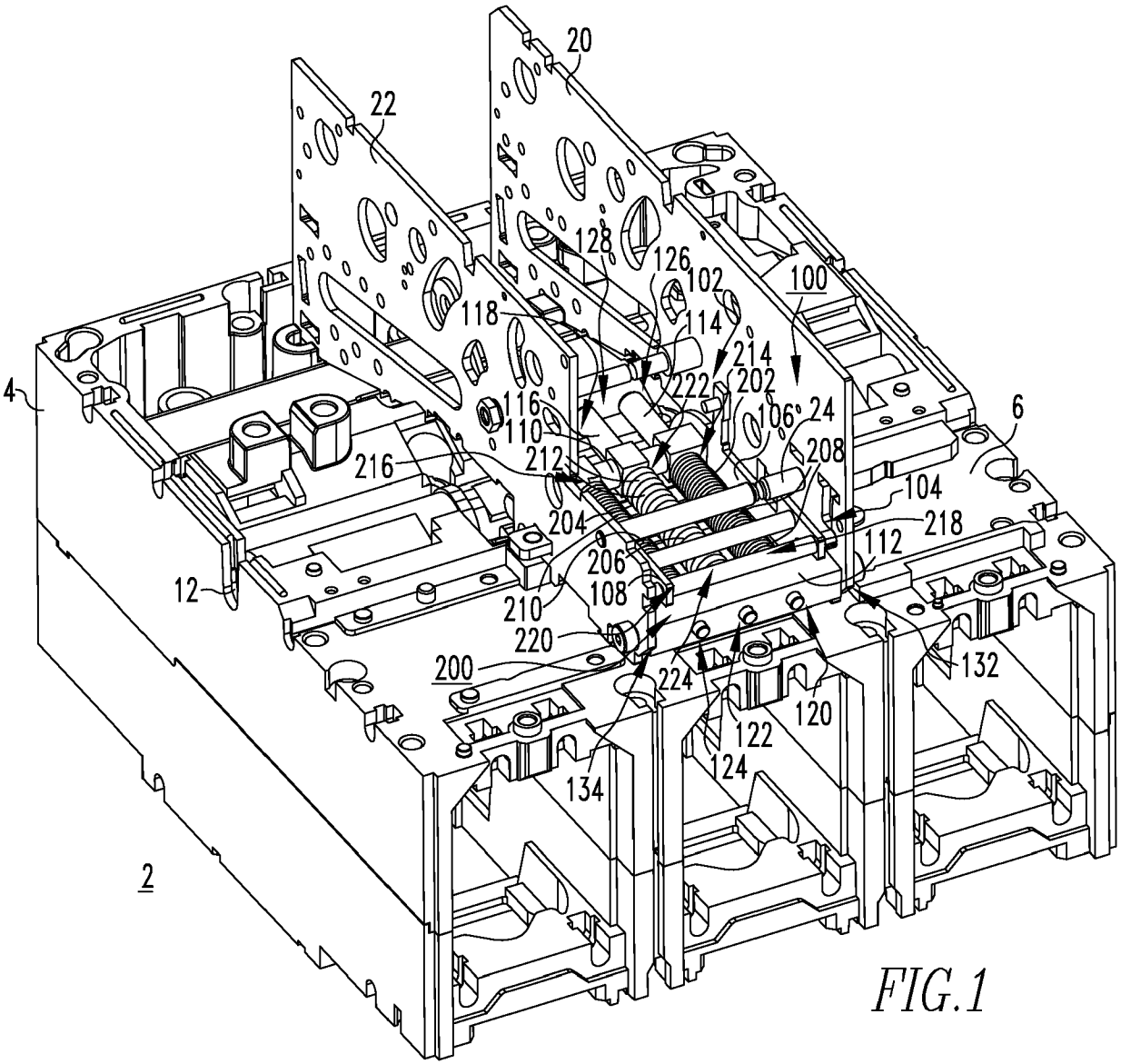
FIG. 1 is an isometric view of a circuit breaker, and a yoke assembly and spring assembly therefor, in accordance with an embodiment of the invention.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, top, bottom, upper, lower, front, back, clockwise, counterclockwise and derivatives thereof, relate to the orientation of the elements shown in the drawings and are not limiting upon the claims unless expressly recited therein.

As employed herein, the term "spring rate" refers to the amount of weight needed to compress a spring a certain distance. For example and without limitation, for linear springs, a spring which has a "low" spring rate is relatively soft, or easier to compress, when compared to a spring having a "high" spring rate. The spring rate can be affected by such factors as, for example and without limitation, the length of the spring, the number of coils of the spring, and the type and dimension (e.g., without limitation, diameter; thickness) of the material (e.g., without limitation, wire) from which the spring is made. It will also be appreciated that springs may have more than one spring rate. For example, the spring may have a first spring rate when compression of the spring is initiated, and a second spring rate when the spring is almost fully compressed, or the spring may have a variable spring rate where, for example, the spring rate increases as the spring is compressed.

As employed herein, the term "indicator" refers to any known or suitable indicia of the status (e.g., without limitation, tripped; open; closed) of the electrical switching apparatus expressly including, but not limited to, a visual indicator such as a colored indicator, a light emitting diode (LED), a trip flag, a suitable word (e.g., "TRIPPED") or a suitable letter (e.g., "T") or other suitable term or indicia, and audible indicators such as a beep or a predetermined tone or a suitable sound. Indicia such as, for example, the words "ON" and "OFF" or positive (+) and negative (−) signs, which indicate non-tripped status of the electrical switching apparatus, are also contemplated by the invention.

As employed herein, the term "interlock" refers to any known or suitable locking mechanism or assembly for locking one component with respect to another and expressly includes, but is not limited to, locking assemblies for resisting the undesired movement of a draw-out circuit breaker from a cassette, and locking assemblies for resisting the undesired movement of a circuit breaker actuator (e.g., without limitation, operating handle).

As employed herein, the term "linking element" refers to any known or suitable mechanism for connecting one component to another and expressly includes, but is not limited to, rigid links (e.g., without limitation, arms; pins; rods), flexible links (e.g., without limitation, wires; chains; ropes), and resilient links (e.g., without limitation, springs).

As employed herein, the terms "yoke" and "yoke assembly" refer to any known or suitable component or assembly, respectively, that is structured to facilitate movement of the pole shaft of an electrical switching apparatus, for example, in order to open, close, or trip open the separable electrical contacts of the electrical switching apparatus, as desired. It will be appreciated that the component or components of yoke assembly, as defined herein, is/are sometimes referred to in the related art as the "cradle assembly," in which case the terms "yoke assembly" and "cradle assembly" are synonymous and may be used interchangeably.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus such as, for example, a low-voltage circuit breaker 2, and a yoke assembly 100 and spring assembly 200 therefor. The circuit breaker 2 includes a housing 4 having a mounting surface 6, a first side plate 20 extending outwardly from the mounting surface 6, and a second side plate 22 extending outwardly from the mounting surface 6 opposite the first side plate 20. A guide member 24, which in the example shown and described herein is a pin, extends between the first and second side plates 20,22 and functions to guide the movement of the yoke assembly 100, as will be discussed. Separable contacts 8 (shown in simplified form in FIG. 3A) are enclosed by the housing 4 (partially shown in phantom line drawing in FIG. 3A). An operating mechanism 10 (shown in simplified form in FIG. 3A) is structured to open and close the separable contacts 8 (FIG. 3A). The operating mechanism 10 (FIG. 3A) includes a pivotable pole shaft 12 (partially shown in FIG. 1; best shown in FIGS. 2A, 2B, 3A, 3B and 4).

The yoke assembly 100 is coupled to the pole shaft 12, as best shown in FIGS. 2A, 2B, 3A and 3B and, as will be discussed, is movable among a first position (FIGS. 1, 2A and 3A) corresponding to the separable contacts 8 (FIG. 3A) being closed, and a second position (FIGS. 2B and 3B) corresponding to the separable contacts 8 (FIG. 3) being open. When the yoke assembly 100 moves between the first or closed position of FIGS. 1, 2A and 3A, and the second or open position of FIGS. 2B and 3B, the spring assembly 200 biases the yoke assembly 100 toward engagement with the guide member 24 (best shown in FIGS. 3A and 3B), in order that the guide member 24 guides the movement of the yoke assembly 100. In this manner, the guide member 24 functions as a fixed fulcrum with respect to which the yoke assembly 100 is effectively and efficiently moved in the desired manner. It will, however, be appreciated that the guide member (e.g., 24) could have any known or suitable alternative shape, configuration, and/or location with respect to the circuit breaker housing 4 and, in particular, the first and second side plates 20,22 thereof, without departing from the scope of the invention.

As shown in FIGS. 2A, 2B, 3A and 3B, the example yoke assembly 100 includes a first end 102 coupled to the pole shaft 12, a second end 104 disposed opposite and distal from the first end 102, a first side 106 extending from the first end 102 toward the second end 104, and a second side 108 (FIGS. 2A and 2B) disposed opposite and distal from the first side 106. At least one cross member 110,112 (two are shown) extends between the first and second sides 106,108 (both shown in FIGS. 2A and 2B). It will, however, be appreciated that the yoke assembly 100 and individual components (e.g., without limitation, sides 106,108; cross members 110,112; elongated members 114,116,118, discussed hereinbelow) could comprise any known or suitable alternative configuration, without departing from the scope of the invention (see, for example, FIG. 4 and the corresponding disclosure hereinbelow).

Figure 2A:
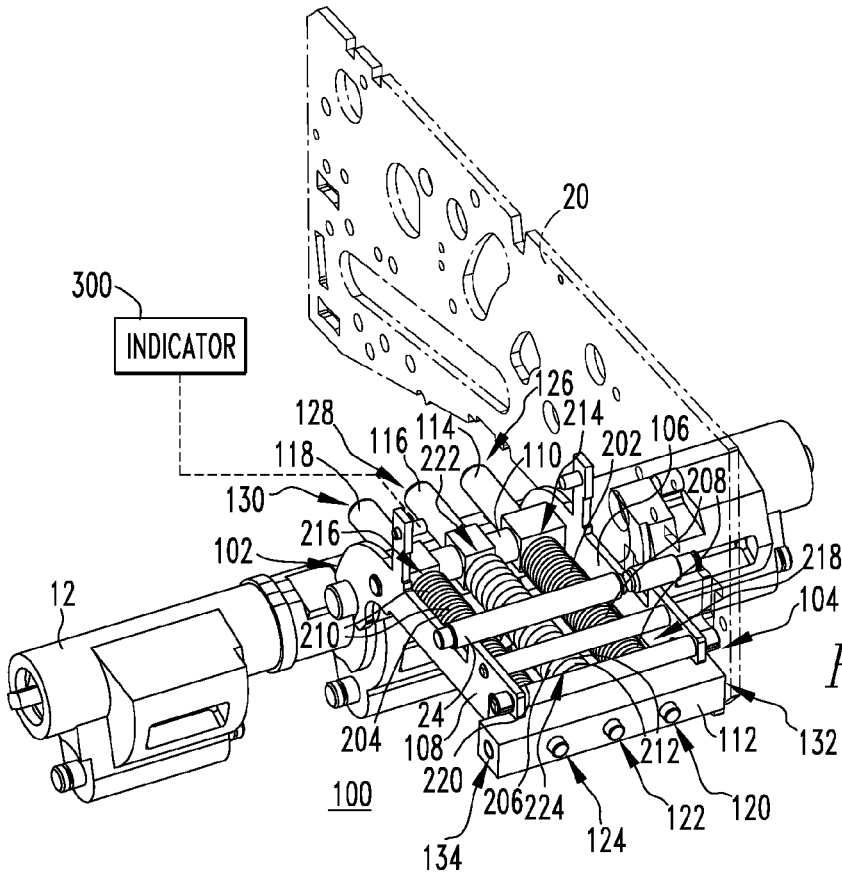
FIGS. 2A and 2B are isometric views of the yoke assembly and spring assembly therefor of FIG. 1, respectively showing the yoke assembly in the positions corresponding to the circuit breaker being closed and open.
Figure 2B:
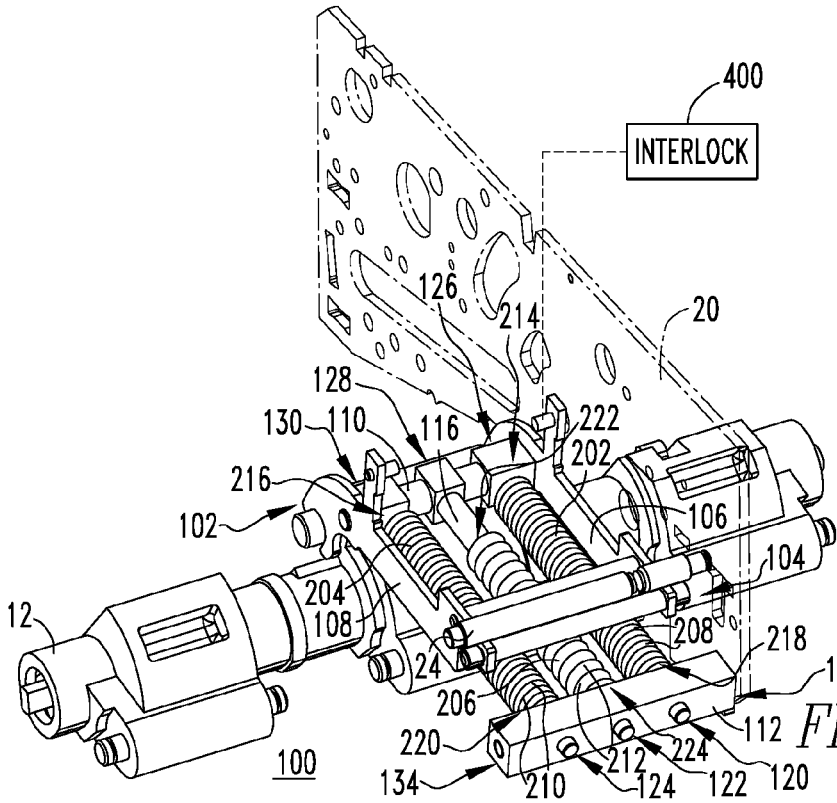
Figure 3A:
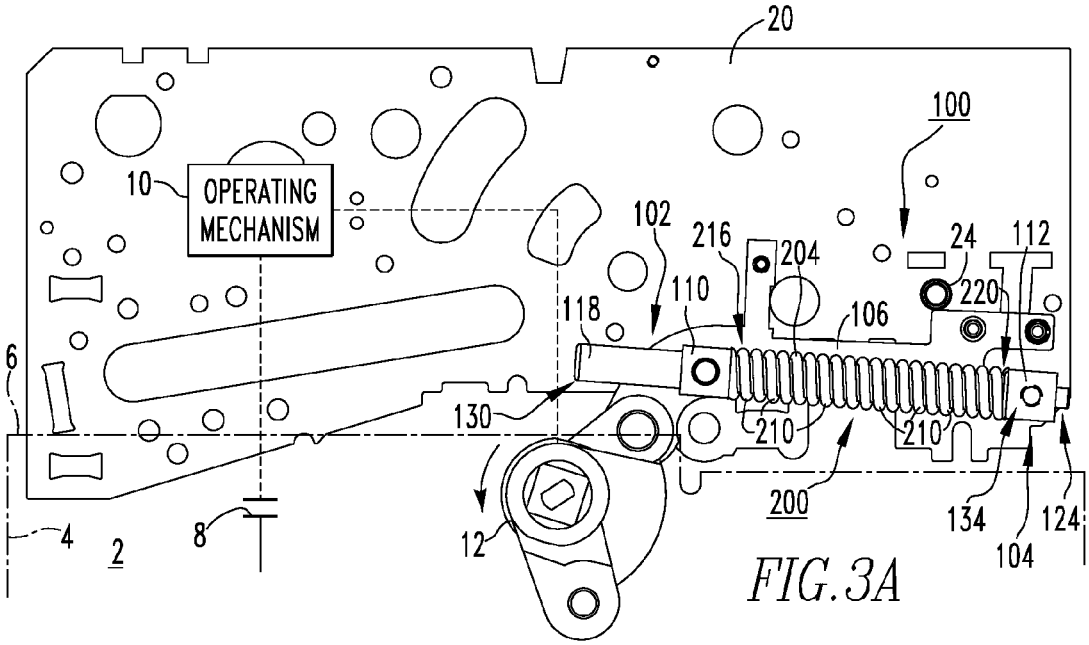
FIGS. 3A and 3B are side elevation views of the yoke assembly and spring assembly therefor of FIGS. 2A and 2B, respectively.
Figure 3B:
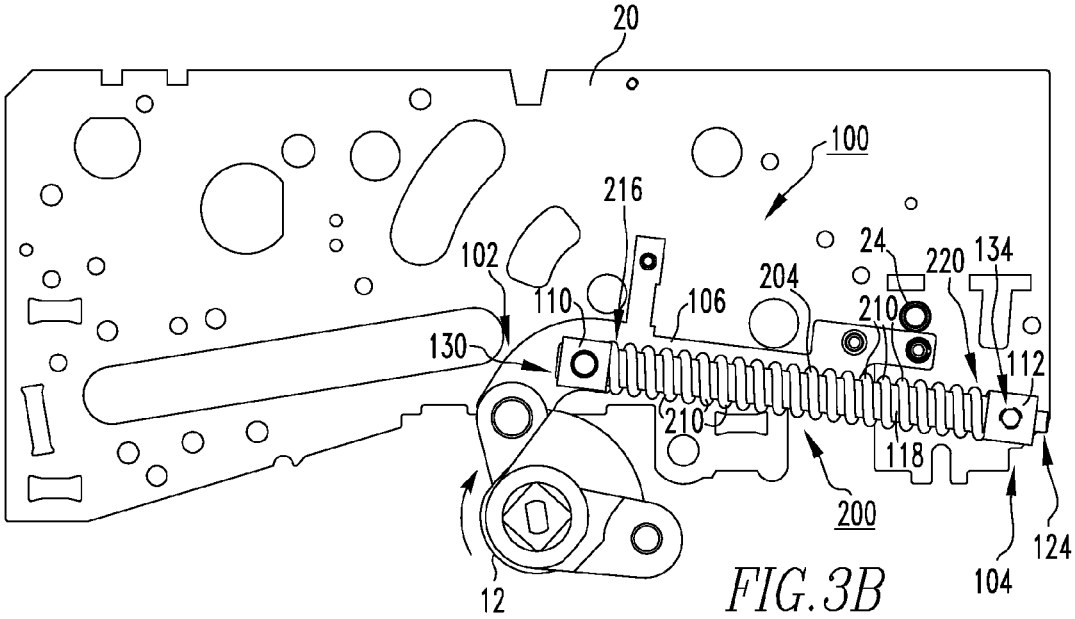

Continuing to refer to FIGS. 2A and 2B, the spring assembly 200 includes a number of first springs 202,204, which have a first spring rate, and a number of second springs 206, which have a second spring rate that is different from the first spring rate of the first springs 202,204. The springs 202,204, 206 are structured to bias the yoke assembly 100 towards the second position of FIG. 2B. More specifically, the example spring assembly 200 includes two first springs 202,204, and a single second spring 206. The spring rate of each of the example first springs 202,204 is lower than the spring rate of the single second spring 206. It will be appreciated that the springs 202,204,206 are shown in somewhat exaggerated form herein, solely for purposes of illustration. In particular, the example second spring 206 is shown to be significantly shorter than the first springs 202,204. Although this may in fact be the case, other embodiments wherein the second spring 206 is the same length (not shown) or almost the same length as the first springs 202,204 are also within the scope of the invention. Additionally, the two first springs 202,204 are shown to include more coils 208,210 than the coils 212 of the single second spring 206, and the coils 208,210 of the two first springs 202,204 are shown to be smaller (e.g., thinner) than the coils 212 of the single second spring 206. It is through the use of such a combination of springs (e.g., 202,204,206), or some suitable alternative combination thereof, that the bias forces applied by the springs 202,204,206 on the yoke assembly 100 and, in turn, the pole shaft 12, are preferably optimized.

Specifically, the disclosed spring assembly 200 provides superior circuit breaker performance by enabling a relatively high initial opening velocity through the use of the single second spring 206, which has a higher spring rate and shorter length (best shown in FIG. 2B) than the two first springs 202,204. Hence, the single second spring 206 participates in the circuit breaker opening process only when the process begins. The two first springs 202,204, which are longer, then take over and continue to open the circuit breaker, but at a lower velocity. Among other advantages, this design resists undesirable bounce or rebound of the yoke assembly 100, or of the separable contacts (FIG. 3A), and enables a smaller closing spring (not shown) or a plurality of springs (not shown) to be employed by the closing assembly (not shown). This is because the opening springs 202,204,206 apply less of a bias in opposition to the spring force of the circuit breaker closing assembly (not shown).

More specifically, the example yoke assembly 100 includes two cross members, a first cross member 110 extending between the first and second sides 106,108 of the yoke assembly 100 proximate the first end 102 of the yoke assembly 100 and a second cross member 112 extending between the first and second sides 106,108 of the yoke assembly 100 proximate the second end 104 thereof, as shown in FIG. 1. The second cross member 112 includes first and second ends 132,134 pivotably coupled to the first and second side plates 20,22 (both shown in FIG. 1), respectively, of the circuit breaker 2 (FIG. 1; partially shown in phantom line drawing in FIG. 3A), in order to provide a fixed pivot point for the yoke assembly 100 to move with respect to the first and second side plates 20,22 (both shown in FIG. 1). Three elongated members 114,116,118 have first ends 120,122,124, respectively, that are fixedly coupled to the second cross member 112, and second ends 126,128,130 that extend through the first cross member 110 and are movable with respect thereto. This aspect of the disclosed yoke assembly 100 will be further appreciated by comparing FIG. 2A to FIG. 2B, and by comparing FIG. 3A to FIG. 3B. Specifically, each of the two first springs 202,204 is disposed on a corresponding one of the elongated members 114,118, with the elongated members 114,118 extending through the coils 208,210, respectively, of the springs 202,204. The single second spring 206 is disposed on the other elongated member 116, between the two first springs 202,204, with the coils 212 of the single second spring 206 receiving the elongated member 116 therethrough.

As previously discussed, the example single second spring 206 is shorter than the example two first springs 202,204, which are preferably the same length, as best shown in FIG. 2B. Thus, when the yoke assembly 100 is disposed in the first or closed position of FIG. 2A, the first end 222 of the single second spring 206 is disposed at or about the first cross member 110 of the yoke assembly 100, and the second end 224 of the single second spring 206 is disposed at or about the second cross member 112. However, because of the shorter length (shown in exaggerated form herein, solely for simplicity of illustration), when the yoke assembly 100 is disposed in the second or open position of FIG. 2B, the first end 222 of the single second spring 206 is spaced apart from the first cross member 110. Accordingly, as previously discussed, it will be appreciated that the single second spring 206, which has a higher spring rate than the two first springs 202,204, functions to bias the yoke assembly 100 initially, in order to provide a relatively high initial opening velocity as the yoke assembly starts moving from the closed position of FIG. 2A toward the open position of FIG. 2B. Then, after the single second spring 206 is fully extended, the two first springs 202,204, which have a lower spring rate and are longer, finish moving the yoke assembly 100 to the open position of FIG. 2B. Specifically, the two first springs 202,204 of the example shown and described herein, include first ends 214,216 which are disposed at or about the first cross member 110, and second ends 218,220 which are disposed at or about the second cross member 112, both when the yoke assembly 100 is disposed in the first or closed position (FIG. 2A) and when the yoke assembly 100 is disposed in the second or open position (FIG. 2B). It will, however, be appreciated that the yoke assembly 100 and, in particular, the sides (e.g., 106,108) of the yoke assembly 100 could have any known or suitable alternative configuration (not shown), for example, with respect to the guide member 24, which could also be disposed in a suitable alternative location (not shown). It will also be appreciated that the spring assembly 200 could have any known or suitable alternative number, type (e.g., without limitation, compression; tension (not shown)) and/or configuration of springs (e.g., 202,204,206).

Figure 4:
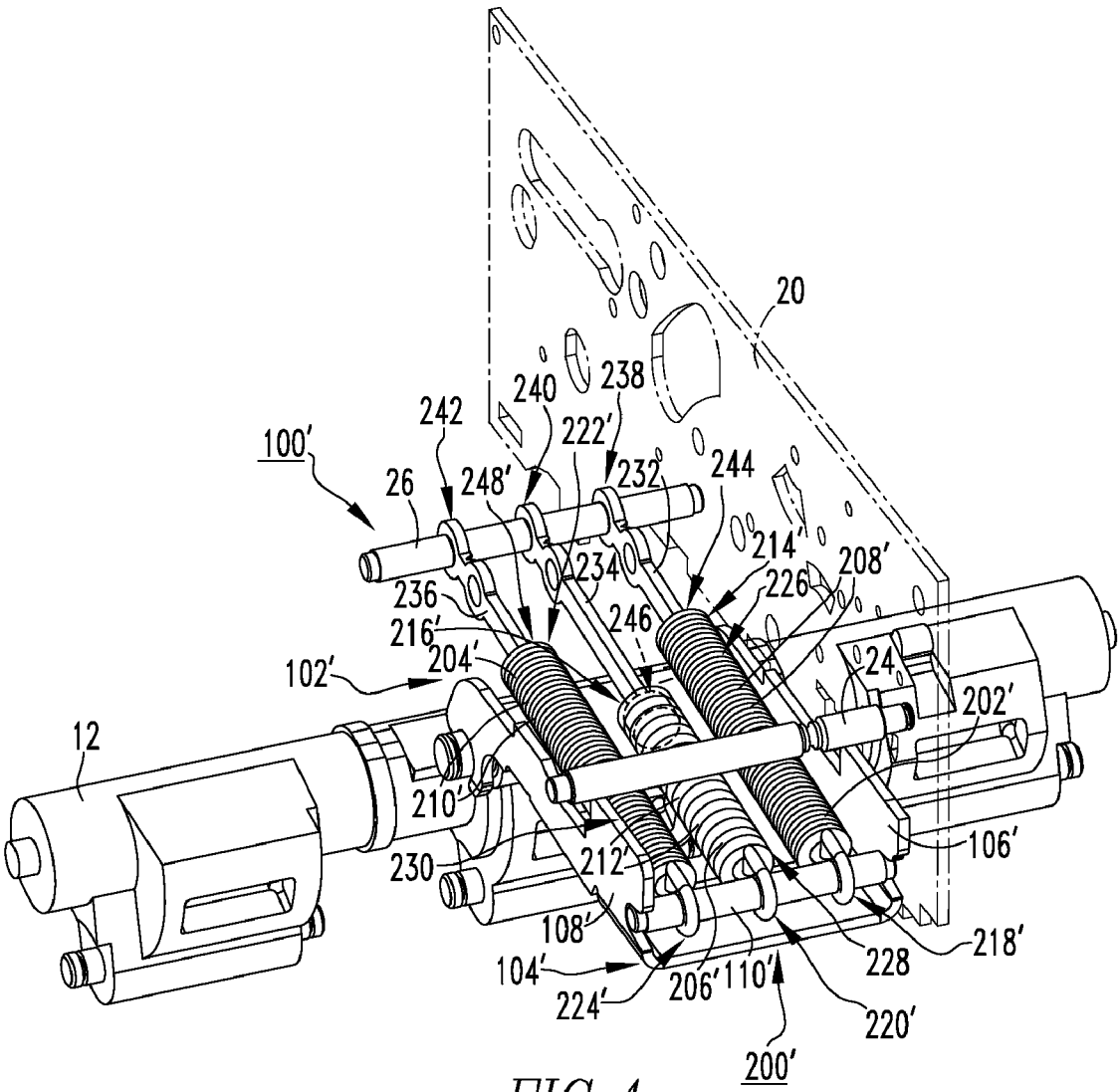
FIG. 4 is an isometric view of a yoke assembly and spring assembly therefor, in accordance with another embodiment of the invention.

For example, FIG. 4 shows one non-limiting example of an alternative yoke assembly 100' and spring assembly 200' therefor, within the scope of the invention. The example of FIG. 4 is shown solely for the purposes of illustration, and is not intended to limit the scope of the invention. It will be appreciated, therefore, that numerous other yoke assembly (not shown) and spring assembly (not shown) configurations and combinations could be employed, without departing from the scope of the invention. In the example of FIG. 4, the yoke assembly 100' includes first and second opposing ends 102',104', and first and second opposing sides 106',108'. However, unlike the yoke assembly 100, previously discussed with respect to FIGS. 1, 2A, 2B, 3A and 3B, the yoke assembly 100' only includes one cross member 110', which extends between the first and second sides 106',108', at or about the second end 104' of the yoke assembly 100'. Also included is a pin member 26 that extends between the first and second side plates 20,22 (both shown in FIG. 1) of the circuit breaker housing 4 (FIG. 1). The spring assembly 200', like spring assembly 200 discussed hereinabove, includes two first springs 202',204' and a single second spring 206'. Unlike spring assembly 200 (FIGS. 1, 2A, 2B, 3A and 3B), however, each of the springs 202',204',206', respectively includes a first portion 226,228,230 and a second portion 232,234,236. Each of the first portions 226,228,230, respectively includes a plurality of coils 208',210',212', and first and second ends 214', 216',222' and 218',220',224'. The first ends 214',216',222' of the coils 208',210',212' are coupled to the yoke assembly 100' at or about the second end 104' thereof. The second ends 218',220',224' of the coils 208',210',212' are respectively coupled to the second portions 232,234,236 of the springs 202',204',206'. More specifically, each second portion 232, 234,236 has a corresponding first end 238,240,242, which is coupled to the pin member 26, and a second end 244,246,248, which is coupled to the first ends 214',216',222', respectively, of the first portions 226,228,230 of the springs 202',204',206'. The connection between the first and second portions 226, 228,230 and 232,234,236 can be made in any suitable manner. For example and without limitation, as shown in simplified form in hidden line drawing with respect to the single second spring 206', the second end 246 of the second portion 234 of the single second spring 206' can be inserted within the coils 212' of the first portion 228 of the single second spring 206', at or about the first end 216' thereof, and be secured therein, for example and without limitation, by interference fit (e.g., press-fit; threaded engagement). It will, however, be appreciated that any known or suitable alternative number and configuration of springs (e.g., 202',204',206'), other than the two-portion design shown and described with respect to the example of FIG. 4, could be employed. It will also be appreciated that although the second portions 232,234,236 of the example springs 202',204',206', respectively, are substantially flat, that other shapes (not shown) and/or configurations (not shown) are contemplated within the scope of the invention.

Referring again to FIGS. 2A and 2B, another advantage of the disclosed yoke assembly 100, will now be discussed. Specifically, the circuit breaker 2 (FIG. 1) may further include one or both of an indicator 300 (shown in block form in FIG. 2A), as defined herein, and an interlock 400 (shown in block form in FIG. 2B), as defined herein. At least one of the first and second sides 106,108 of the yoke assembly 100 is structured to be coupled directly to the corresponding indicator 300 (see, for example, second side 108 of the yoke assembly

100 coupled to indicator 300 in FIG. 2A) and the interlock 400 (see, for example, first side 106 coupled directly to interlock 400 in FIG. 2B). Accordingly, it will be appreciated, that as the first and second sides 106,108 of the yoke assembly 100 translate back and forth (see, for example, first side 106, which translates left and right with respect to FIGS. 3A and 3B), they provide a reference point from which to directly transfer information concerning the position and, therefore, the status of the circuit breaker 2 (FIG. 1). More specifically, features of the circuit breaker 2 (FIG. 1) such as, for example and without limitation, the aforementioned indicator 300 (FIG. 2A) and interlock 400 (FIG. 2B) can be directly coupled to the first and/or second side(s) 106,108 of the yoke assembly 100, without a plurality of separate linking elements, as defined herein. In this manner, when the yoke assembly 100 and, in particular, the sides 106,108 thereof, move, the yoke assembly 100 actuates the corresponding feature (e.g., without limitation, indicator 300 (FIG. 2A); interlock 400 (FIG. 2B)).

Accordingly, it will be appreciated that the disclosed yoke assemblies 100,100' and spring assemblies 200,200' therefor are preferably structured to optimize circuit breaker performance while occupying a minimal amount of space. This, in turn, enables the overall size of the circuit breaker 2 (FIG. 1) to be reduced. The yoke assemblies 100,100' also provides an effective mechanism for providing information about the status of the circuit breaker 2 (FIG. 1) and/or for actuating features (e.g., without limitation, indicators 300 (FIG. 2A); interlocks 400 (FIG. 2B)) of the circuit breaker 2 (FIG. 1), without requiring a plurality of intermediate linking elements between such feature and the yoke assembly 100,100'. This, in turn, reduces the number of components of the circuit breaker 2 (FIG. 1) and the corresponding cost thereof.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A spring assembly for a yoke assembly of an electrical switching apparatus including a housing, separable contacts enclosed by said housing, and an operating mechanism structured to open and close said separable contacts, said operating mechanism including a pole shaft, said yoke assembly being coupled to said pole shaft and being movable among a first position corresponding to said separable contacts being closed, and a second position corresponding to said separable contacts being open, said spring assembly comprising:

a number of first springs having a first spring rate and being structured to be coupled to said yoke assembly; and a number of second springs having a second spring rate and being structured to be coupled to said yoke assembly, wherein said second spring rate is different than said first spring rate, wherein said number of first springs and said number of second springs are structured to bias said yoke assembly toward said second position;

wherein said yoke assembly comprises a first end coupled to said pole shaft, a second end, a first side, and a second side; wherein the first side of said yoke assembly extends from said pole shaft toward the second end of said yoke assembly; wherein the second side of said yoke assembly is disposed opposite and distal from the first side; and wherein said number of first springs and said number of second springs are structured to be disposed between the first side and the second side;

wherein said yoke assembly further comprises a first cross member extending between the first side and the second side proximate the first end of said yoke assembly, a second cross member extending between the first side and the second side proximate the second end of said yoke assembly, and a plurality of elongated members having first ends and second ends; wherein the first ends of said elongated members are fixedly coupled to said second cross member; wherein the second ends of said elongated members extend through said first cross member and are movable with respect to said first cross member; wherein said number of first springs and said number of second springs are structured to be disposed between said first cross member and said second cross member; and wherein each of said number of first springs and said number of second springs includes a plurality of coils structured to receive a corresponding one of said elongated members therethrough; and wherein said plurality of elongated members is three elongated members; wherein said number of first springs is two first springs; wherein each of said two first springs is disposed on a corresponding one of said three elongated members; wherein said number of second springs is a single second spring; and wherein said single second spring is disposed on a corresponding one of said three elongated members between said two first springs.

2. The spring assembly of claim 1 wherein said single second spring includes a first end and a second end; wherein, when said yoke assembly is disposed in said first position, the first end of said single second spring is structured to be disposed at or about said first cross member and the second end of said single second spring is structured to be disposed at or about said second cross member, wherein, when said yoke assembly is disposed in said second position, the first end of said single second spring is structured to be spaced apart from said first cross member; wherein said two first springs include first ends and second ends; and wherein, when said yoke assembly is disposed in said first position and when said yoke assembly is disposed in said second position, the first ends of said two first springs are structured to be disposed at or about said first cross member, and the second ends of said two first springs are structured to be disposed at or about said second cross member.

3. A yoke assembly for an electrical switching apparatus including a housing, separable contacts enclosed by said housing, and an operating mechanism structured to open and close said separable contacts, said operating mechanism including a pole shaft, said yoke assembly comprising:

a first end structured to be coupled to said pole shaft;

a second end;

a first side extending from the first end toward the second end;

a second side disposed opposite and distal from the first side;

at least one cross member extending between the first side and the second side; and a spring assembly comprising:

a number of first springs having a first spring rate and being coupled to said yoke assembly, and a number of second, springs having a second spring rate and being coupled to said yoke assembly, wherein said second spring rate is different than said first spring rate, wherein said yoke assembly is structured to be movable among a first position corresponding to said separable contacts being cl6sed, and a second position corresponding to said separable contacts being open, wherein said number of first springs and said number of second springs bias said yoke assembly toward said second position;

wherein said at least one cross member is a first cross member extending between the first side and the second side proximate the first end of said yoke assembly, and a second cross member extending between the first side and the second side proximate the second end of said yoke assembly; wherein said spring assembly further comprises a plurality of elongated members fixedly coupled to said second cross member and movably coupled to said first cross member; wherein said number of first springs of said spring assembly and said number of second springs of said spring assembly are disposed between said first cross member and said second cross member; wherein each of said number of first springs and said number of second springs includes a plurality of coils; and wherein each of said elongated members is disposed within the coils of a corresponding one of said number of first springs and said number of second springs; and wherein said spring assembly is disposed between the first side and the second side; wherein said plurality of elongated members is three elongated members; wherein said number of first springs is two first springs; wherein each of said two first springs is disposed on a corresponding one of said three elongated members; wherein said number of second springs is a single second spring; and wherein said single second spring is disposed on a corresponding one of said three elongated members between said two first springs.

4. The yoke assembly of claim 3 wherein said single second spring includes a first end and a second end; wherein, when said yoke assembly is disposed in said first position, the first end of said single second spring is disposed at or about said first cross member and the second end of said single second spring is disposed at or about said second cross member; wherein, when said yoke assembly is disposed in said second position, the first end of said single second spring is spaced apart from said first cross member, wherein said two first springs include first ends and second ends; and wherein, when said yoke assembly is disposed in said first position and when said yoke assembly is disposed in said second position, the first ends of said two first springs are disposed at or about said first cross member, and the second ends of said two first springs are disposed at or about said second cross member.

5. An electrical switching apparatus comprising:

a housing;

separable contacts enclosed by said housing;

an operating mechanism structured to open and close said separable contacts, said operating mechanism including a pole shaft; and a yoke assembly coupled to said housing, said yoke assembly comprising:

a first end coupled to said pole shaft, a second end, a first side extending from the first end toward the second end, a second side disposed opposite and distal from the first side, at least one cross member extending between the first side and the second side, and a spring assembly comprising:

a number of first springs having a first spring rate and being coupled to said yoke assembly, and a number of second springs having a second spring rate and being coupled to said yoke assembly, wherein said second spring rate is different than said first spring rate, wherein said yoke assembly is movable among a first position corresponding to said separable contacts being closed, and a second position corresponding to said separable contacts being open, wherein said number of first springs and said number of second springs bias said yoke assembly toward said second position;

wherein said at least one cross member is a first crass member extending between the first side of said yoke assembly and the second side of said yoke assembly proxirirnte the first end of said yoke assembly, and a second cross member extending between the, first side of said yoke assembly and the second side of said yoke assembly proximate the second end of said yoke assembly; wherein said spring assembly further comprises a plurality of elongated members fixedly coupled to said second cross member and movably coupled to said first cross member; wherein said number of first springs of said spring assembly and said number of second springs of said spring assembly are disposed between said first cross member and said second cross member; wherein each of said number of first springs and said number of second springs includes a plurality of coils; and wherein each of said elongated members is disposed within the coils of a corresponding one of said number of first springs and said number of second springs; and wherein said plurality of elongated members is three elongated members; wherein said number of first springs is two first springs; wherein each of said two first springs is disposed on a corresponding one of said three elongated members; wherein said number of second springs is a single second spring; and wherein said single second spring is disposed on a corresponding one of said three elongated members between said two first springs.

6. The electrical switching apparatus of claim 5 wherein said single second spring includes a first end and a second end; wherein, when said yoke assembly is disposed in said first position, the first end of said single second spring is disposed at or about said first cross member and the second end of said single second spring is disposed at or about said second cross member; wherein, when said yoke assembly is disposed in said second position, the first end of said single second spring is spaced apart from said first cross member; wherein said two first springs include first ends and second ends; and wherein, when said yoke assembly is disposed in said first position and when said yoke assembly is disposed in said second position, the first ends of said two first springs are disposed at or about said first cross member, and the second ends of said two first springs are disposed at or about said second cross member.

* * * * *